US012767479B2

(12) United States Patent
Casotti

(10) Patent No.: US 12,767,479 B2
(45) Date of Patent: Oct. 20, 2026

(54) METHOD AN APPARATUS FOR SEPARATING TWO SUCCESSIVE STACKS OF INTERFOLDED SHEETS OF A TYPE JOINED BY A PRE-TEAR OR PERFORATION LINE AND FOR OBTAINING A PACK OF INTERFOLDED SHEETS WHEREIN AN END SHEET OF THE PACK IS FOLDED TO DEFINE A GRIPPABLE FLAP FOR A FACILITATED EXTRACTION OF THE SHEETS FROM THE PACK

(71) Applicant: OT LUCCA S.R.L., Montecarlo (IT)

(72) Inventor: Paolo Casotti, Lucca-Frazione Di Antraccoli (IT)

(73) Assignee: OT LUCCA S.R.L., Montecarlo (IT)

( * ) Notice: Subject to any disclaimer, the term of this patent is extended or adjusted under 35 U.S.C. 154(b) by 141 days.

(21) Appl. No.: 18/712,475

(22) PCT Filed: Nov. 25, 2022

(86) PCT No.: PCT/IB2022/061435
§ 371 (c)(1),
(2) Date: May 22, 2024

(87) PCT Pub. No.: WO2023/100048
PCT Pub. Date: Jun. 8, 2023

(65) Prior Publication Data

US 2025/0019200 A1 Jan. 16, 2025

(30) Foreign Application Priority Data

Nov. 30, 2021 (IT) ..... 102021000030209

(51) Int. Cl.
*B65H 45/24* (2006.01)
*B65H 31/30* (2006.01)
(Continued)

(52) U.S. Cl.
CPC ..... *B65H 45/24* (2013.01); *B65H 31/3054* (2013.01); *B65H 31/32* (2013.01);
(Continued)

(58) Field of Classification Search
CPC ..... B65H 45/20; B65H 45/24; B65H 45/30; B65H 31/30
See application file for complete search history.

(56) References Cited

U.S. PATENT DOCUMENTS 4,770,402 A * 9/1988 Couturier ..... B65H 31/32 270/39.02
5,730,695 A * 3/1998 Hauschild ..... B65H 31/32 270/39.02

(Continued)

FOREIGN PATENT DOCUMENTS

EP 1640305 A1 3/2006

OTHER PUBLICATIONS

International Search Report and Written Opinion for International Application No. PCT/IB2022/061435, mailed on Feb. 28, 2023, 8 pages.

*Primary Examiner* — Michael Mccullough
(74) *Attorney, Agent, or Firm* — Jacob M. Ward; Ward Law Office LLC

(57) ABSTRACT

The method for separating two successive stacks (PA. PB) of interfolded sheets comprises: once having released the formed stack (PA) on a conveyor (O), moving the two support tables (11, 12), one following another, in such a way as to fold the strip(S) of sheets hanging below the successive stack (PB) under formation supported by the pair of separator elements (14, 15), in such a way that, when the two support tables (11, 12) are brought to face one another or moved towards one another to support the successive stack (PB) under formation, an end flap (F3) of the lower sheet of the successive stack (PB) under formation is partially folded
(Continued)

and hanging between the two support tables to form a grippable flap (L) for a facilitated extraction of the sheets from the pack (P) which is obtained once the formation of the successive stack (PB) is completed.

10 Claims, 10 Drawing Sheets

(51) Int. Cl.
*B65H 31/32* (2006.01)
*B65H 45/18* (2006.01)
*B65H 45/20* (2006.01)

(52) U.S. Cl.
CPC ..... *B65H 45/18* (2013.01); *B65H 45/20* (2013.01); *B65H 2406/122* (2013.01); *B65H 2701/1924* (2013.01)

(56) References Cited

U.S. PATENT DOCUMENTS

| | | | | |
|---|---|---|---|---|
| 7,997,570 | B2 * | 8/2011 | De Matteis | B65H 31/32 270/39.02 |
| 8,240,652 | B2 * | 8/2012 | De Matteis | B65H 31/10 270/39.02 |
| 8,240,653 | B2 * | 8/2012 | Walsh | B65H 45/24 270/39.02 |
| 8,419,002 | B2 | 4/2013 | Walsh et al. | |
| 11,084,681 | B2 * | 8/2021 | Andersson | B65H 45/24 |
| 2012/0207579 | A1 * | 8/2012 | Ricci | B65H 31/30 414/802 |
| 2014/0361033 | A1 * | 12/2014 | Andersson | A47K 10/16 221/33 |
| 2016/0090263 | A1 * | 3/2016 | Walsh | B65H 29/56 270/39.02 |
| 2024/0199363 | A1 * | 6/2024 | Damiani | B65H 45/24 |

* cited by examiner

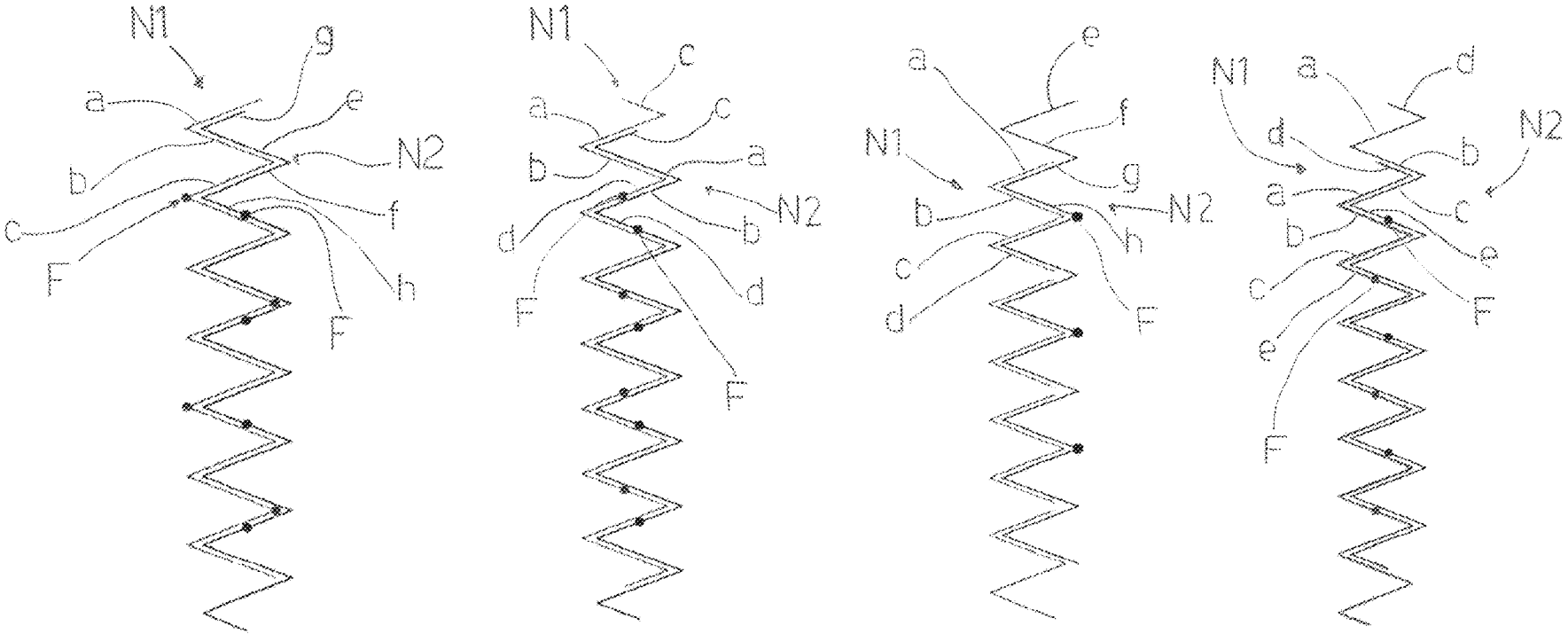
FIG.1A
FIG.1B
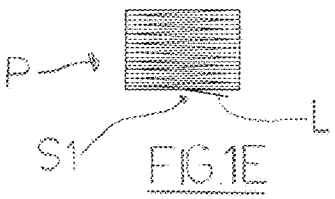
FIG.1E
FIG.1C
FIG.1D

METHOD AN APPARATUS FOR SEPARATING TWO SUCCESSIVE STACKS OF INTERFOLDED SHEETS OF A TYPE JOINED BY A PRE-TEAR OR PERFORATION LINE AND FOR OBTAINING A PACK OF INTERFOLDED SHEETS WHEREIN AN END SHEET OF THE PACK IS FOLDED TO DEFINE A GRIPPABLE FLAP FOR A FACILITATED EXTRACTION OF THE SHEETS FROM THE PACK

FIELD OF THE INVENTION

The present invention relates to the technical sector concerning production of paper material in packs of interfolded sheets, i.e. with the folded sheets in a zig-zag with respect to one another, such as for example packs of paper handkerchieves, paper napkins, paper hand-towels, and the like.

In this technical sector, the sheets that are to be folded in an interfolded way for the formation of a stack (pack) of sheets are usually fed in the form of continuous strips to unwinding and folding means which are configured and predisposed to fold the strips or single sheets in an interfolded way by carrying out one or more folds, to define a series of sheets folded one on another and obtain packs with a desired number of interfolded sheets.

Before, or during the unwinding and folding of the strips, pre-tear lines or perforations are realised thereon, at determined reciprocal distances in relation to the type and number of folds that are to be carried out for realising the pack of interfolded sheets (for example 2 or 3 or 4 panels, with the term "panel" relating to the portion of band folded to form a sheet of the stack of interfolded sheets).

By folding the continuous strips in this way, a stack of interfolded and intercalated sheets is formed, which, once the prefixed height has been reached (i.e. the desired number of folded sheets) for the type of products (complete pack), the stack must be separated using special separation means from the successive stack of interfolded sheets under formation; the separation between the two stacks takes place at the pre-tear lines or perforations.

DESCRIPTION OF THE PRIOR ART

The apparatuses designed to perform these operations are known as interfolding machines.

By way of example figures from 1A to 1D illustrate various modes of folding of two continuous strips of paper material so as to obtain a succession of interfolded and intercalated sheets, in which the folded sheets in a zig zag fashion comprise pre-tear lines or perforations (denoted and illustrated with dots), which will then enable the separation of the sheets once the stack of interfolded sheets at the prefixed height has been formed (i.e. with a predetermined number of interfolded sheets).

For example, FIG. 1A the two continuous strips (N1, N2) of paper material are respectively folded in a zig-zag with respect to one another in such a way that a first strip (N1) is folded to form a succession of series of three whole sheets (a, b, c) (or three whole panels) folded and intercalated on the sheets obtained by the folding of the second strip (N2), where the second strip (N2) is folded in such a way as to form a succession of series of two whole sheets (e, f) (two whole panels) between two half-sheets (g, h) (or two semi-panels).

The series of three whole sheets (a, b, c) of the first strip (N1) and the series of two whole sheets (e, f) and two half-sheets (g, h) of the second strip (N2) are separated from one another between pre-tear or perforation lines (F), denoted and illustrated with dots, which are realised on the strips before they are folded.

Once a number of folds of the two strips (N1, N2) has been carried out such as to define a stack of interfolded sheets of a desired height, the formed and completed stack of sheets must be separated from a successive stack of sheets under formation by means of the use of separation means which determine the detaching of the strips/sheets at the pre-tear or perforation lines, separating the formed stack from the successive stack under formation. In this case the pack obtained will be a pack of sheets having three panels, interfolded and intercalated (known in the 3-panels jargon as tab bonds), where tab-bond indicates the presence of the pre-tear lines or perforations between the various series of interfolded and intercalated sheets).

Also in FIG. 1B, the two continuous strips (N1, N2) of paper material are respectively folded in a zig-zag with respect to one another in such a way as to obtain a pack of sheets having series of three interfolded and intercalated panels where both the first strip (N1) and the second strip (N2) are folded in a zig-zag with respect to one another in such a way that on both a succession of series of two whole sheets is realised (a, b) (two whole panels) between two half-sheets (c, d) (or two semi-panels) separated from one another by pre-tear lines or perforations (F) realised on the strips before they are folded.

Once a number of folds of the two strips (N1, N2) has been carried out such as to define a stack of interfolded sheets of a desired height, the formed and completed stack of sheets must be separated from a successive stack of sheets under formation by means of the use of separation means which determine the detaching of the strips/sheets at the pre-tear or perforation lines, separating the formed stack from the successive stack under formation.

In this case too the pack obtained will be a pack of sheets having three interfolded and intercalated panels (known in the 3-panels jargon as tab bonds, where tab-bond indicates the presence of the pre-tear lines or perforations between the various series of interfolded and intercalated sheets). FIGS. 1C and 1D instead illustrate a different mode of folding the first strip (N1) and the second strip (N2) to obtain packs of sheets having four panels, interfolded and intercalated, and folded into a W shape.

In the example of FIG. 1C, the first strip (N1) has been sectioned into a series of portions of strip which are then each folded into four sheets (or four panels) (a, b, c, d) folded in a W shape and interfolded and intercalated with the sheets obtained from the folding of the second strip (N2), also folded to form a series of four sheets (e, f, g, h), folded in a W shape, separated from one another by pre-tear lines or perforations (F) (denoted with dots) previously realised on the same second strip (N2).

Once a number of folds of the two strips (N1, N2) has been carried out such as to define a stack of interfolded sheets of a desired height, the formed and completed stack of sheets must be separated from a successive stack of sheets under formation, by means of the use of separation means which determine the detaching of the strips/sheets at the pre-tear or perforation lines, separating the formed stack from the successive stack under formation. In this case the pack obtained will be a pack of sheets having four panels, interfolded and intercalated, and folded in a W shape (known in the 4-panels jargon as tab bonds and clean cuts), where the term clean cut identifies the series of 4 panels separated from one another and folded in an interfolded and intercalated way with the series of 4 panels instead being joined by the pre-tear lines or perforations, or tab bonds).

In FIG. 1D, on the other hand, the two continuous strips (N1, N2) of paper material are respectively folded with respect to one another in such a way as to obtain a pack of sheets having a succession of series of four panels, interfolded and intercalated where both the first strip (N1) and the second strip (N2) are folded in a zig-zag with respect to one another in such a way that on both a succession of series of three whole sheets is realised (a, b, c) (three whole panels) between two half-sheets (d, e) (or two semi-panels) separated from one another by pre-tear lines or perforations (F) realised on the strips before they are folded.

Once a number of folds of the two strips (N1, N2) has been carried out such as to define a stack of interfolded sheets of a desired height, the formed and completed stack of sheets must be separated from a successive stack of sheets under formation by means of the use of separation means which determine the detaching of the strips/sheets at the pre-tear or perforation lines, separating the formed stack from the successive stack under formation.

In this case the pack obtained will be a pack of sheets having four panels, interfolded and intercalated (known in the 4-panels jargon as tab bonds).

The present invention relates to a method and an apparatus for separating two successive stacks of interfolded sheets of a type joined by a pre-tear or perforation line (such as for example those obtainable following the various types of folding described in the foregoing and illustrated in figures from 1A to 1D) and for obtaining a pack of interfolded sheets wherein an end sheet of the pack is partially folded on itself to define a grippable flap for a facilitated extraction of the sheets from the pack.

An example of a pack (P) of interfolded sheets obtainable with the invention in which an end sheet (S1) of the pack (P) is partially folded on itself to define a grippable flap (L) for a facilitated extraction of the sheets from the pack is schematically illustrated in FIG. 1E.

An apparatus (A) and a method of the prior art for separating two successive stacks of interfolded sheets of a type joined by a pre-tear or perforation line (such as for example those obtainable following the various types of folding described in the foregoing and illustrated in figures from 1A to 1D) and for obtaining a pack of interfolded sheets are described in document EP1640305, of which some drawings are included here in figures from 2A to 2D.

The apparatus (A) comprises unwinding and folding means (M) of two continuous strips of paper material for folding the two strips with respect to one another in such a way as to obtain folded sheets in an interfolded and intercalated way and overlapping one another to form a stack (P1) of interfolded and intercalated sheets and support means (21) for the support of the stack (P1) of sheets during the formation thereof (see for example FIG. 2A).

Before, or during the folding of the two strips, pre-tear lines or perforations are realised thereon.

The support means (21) are constituted by a support table (21) (in the shape of an overturned L) which is vertically movable in such a way as to be positionable in a raised position in which it is positioned in proximity of the unwinding and folding means (M), in order to start to receive and support the folded sheets, and lowerable vertically downwards in order to enable the formation of a stack (P1) of interfolded sheets (see for example FIGS. 2A and 2B) of the desired height (i.e. a predetermined number of folded sheets).

The apparatus (A) further comprises a pair of separator elements (10, 11) for carrying out a separation between consecutive sheets of a completed and formed stack (P1) and a successive stack (P2) under formation.

The separator elements (10, 11) are arranged bilaterally of the vertical direction along which the stacks of folded sheets are formed and are movable transversally to the vertical direction of formation of the stack of folded sheets between a splayed position (FIG. 2A), in which they are splayed in order to enable the formation of the stack of folded sheets on the support table (21), and a neared position, in which they are neared to one another so as to insert between consecutive sheets of an already-formed stack (P1) and a successive stack (P2) under formation (see FIG. 2B).

With the aim of realising the separation between the completed and formed stack (P1) and the successive stack (P2) under formation, the apparatus (A) comprises a separating board (20) which is movable in such a way as to insert laterally and transversally, beneath the separator elements (10, 11), at the connecting sheets between the formed stack (P1) and the successive stack (P2) under formation.

Once the separating board (20) has inserted laterally between the two stacks, to abut the reciprocal connecting sheets, the separating board (20) and the support table (21), which grip between them the formed stack (P1), are sharply translated vertically downwards, towards a conveyor belt, in such a way as to perform a tear, at the pre-tear or perforation line present in the connecting sheets between the two stacks, and thus a separation of the formed stack (P1) from the successive stack (P2) under formation (see FIG. 2C).

During these operations, the successive stack (P2) under formation is supported by the separator elements (10, 11), which are maintained in the neared position thereof, with at least a lower sheet (L1) (FIG. 2C) which remains hanging beneath the separator elements (10, 11) (this hanging lower sheet constituted the connection sheet with the last sheet of the already-formed stack (P1).

Once the formed stack has been released onto the conveyor, the separating board (20) is returned vertically upwards and newly translated transversally to the vertical direction of formation of the successive stack (P2) so as to insert laterally below the successive stack (P2) under formation with the aim of abutting the hanging sheet (L1) and folding it below the successive stack (P2) under formation (see FIG. 2D).

Then, the support table (21) is moved upwards so as to be returned into the first raised position in order to support the new stack (P2) under formation, and thus enable the separator elements (10, 11) to be returned into the splayed position and to the separating board (20) to be moved transversally and laterally externally of the stack (P2) under formation (FIG. 2A).

The operations and steps described in the foregoing, and illustrated in the sequence of figures from 2A to 2D, are cyclically repeated to allow formation of stacks of interfolded and intercalated sheets and the separation of the stacks once formed and completed.

An apparatus such as this one, though on the one hand enabling separation of two successive stacks of interfolded sheets of a type joined by a pre-tear or perforation line, and obtain packs of interfolded sheets, on the on the other hand does not allow for high productivity, i.e. a high number of formed stacks which have also been separated in the unit of time (for example in an hour), as the separating board, once used for the separation of the formed stack from the successive stack under formation, is also used for folding the sheet that remains hanging beneath the stack under formation.

This delays the repositioning of the support table in the raised position for supporting the stack under formation, and the movement of the separator elements into the splayed position thereof.

In fact, the support table must wait for the separating board to be moved so as to fold the sheet that remains hanging beneath the stack under formation before being returned into the raised position thereof for supporting the stack under formation.

Further, it is not possible to increase, beyond a certain limit, the velocity of the unwinding and folding of the two continuous strips as this is limited by the activation cycle of the separating board.

Lastly, with the apparatus and method described in that document it is not possible to obtain a pack of interfolded sheets in which an end sheet of the pack is partially folded on itself to define a grippable flap for a facilitated extraction of the sheets from the pack.

SUMMARY OF THE INVENTION

The aim of the present invention is therefore to describe a method and an apparatus for separating two successive stacks of interfolded sheets of a type joined by a pre-tear or perforation line and for obtaining a pack of interfolded sheets able to guarantee a production regime that is high level and which at the same time can realise packs of interfolded sheets in which an end sheet of the pack is partially folded on itself to define a grippable flap for a facilitated extraction of the sheets from the pack.

The cited aim is attained by means of a method and an apparatus according to the claims.

BRIEF DESCRIPTION OF THE DRAWINGS

The characteristics of a preferred, but not exclusive, embodiment of the method and apparatus of the present invention will be described in the following description with reference to the appended tables of drawings, in which:

FIGS. from 1A to 1D, already mentioned in the foregoing, schematically illustrate various modes of folding two continuous strips for the formation of successive stacks of interfolded sheets of a type joined by a pre-tear or perforation line;

FIG. 1E schematically illustrates a pack of interfolded sheets with an end sheet of the pack being partially folded on itself so as to form a grippable flap for a facilitated extraction of the sheets from the pack obtainable according to the method and apparatus of the invention;

FIGS. from 2A to 2D, also mentioned in the foregoing, schematically illustrate the apparatus and operating steps described in document EP1640305 for the separation of stacks of interfolded sheets and the obtaining of packs of interfolded sheets without a grippable flap;

FIGS. from 3A to 3I and FIGS. to 3L to 3P illustrate, in respective schematic views, a possible succession of operating steps of the method of the invention, and of the apparatus for carrying out the method, for separating two successive stacks of interfolded sheets of a type joined by a pre-tear or perforation line and for obtaining a pack of interfolded sheets in which an end sheet of the pack is partially folded on itself to define a grippable flap for a facilitated extraction of the sheets from the pack, such as the pack (P) illustrated in FIG. 1E.

DESCRIPTION OF THE PREFERRED EMBODIMENTS

The method of the present invention, for separating two successive stacks (PA, PB) of interfolded sheets of a type joined by a pre-tear or perforation line and for obtaining a pack (P) of interfolded sheets wherein an end sheet (S1) of the pack (P) is partially folded on itself to define a grippable flap (L) for a facilitated extraction of the sheets from the pack, comprises:

predisposing a pair of support tables (11, 12) movable independently of one another;

predisposing a separating board (13), movable independently of the pair of support tables (11, 12);

predisposing a pair of separator elements (14, 15) arranged facing one another and movable independently of one another and independently of the pair of support tables (11, 12) and of the separating board (13).

Figure 2A:
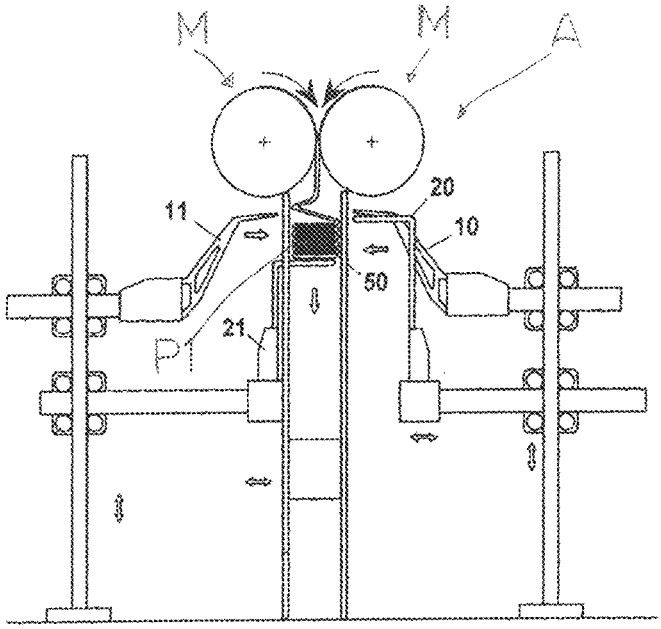
FIG.2A PRIOR ART
Figure 2B:
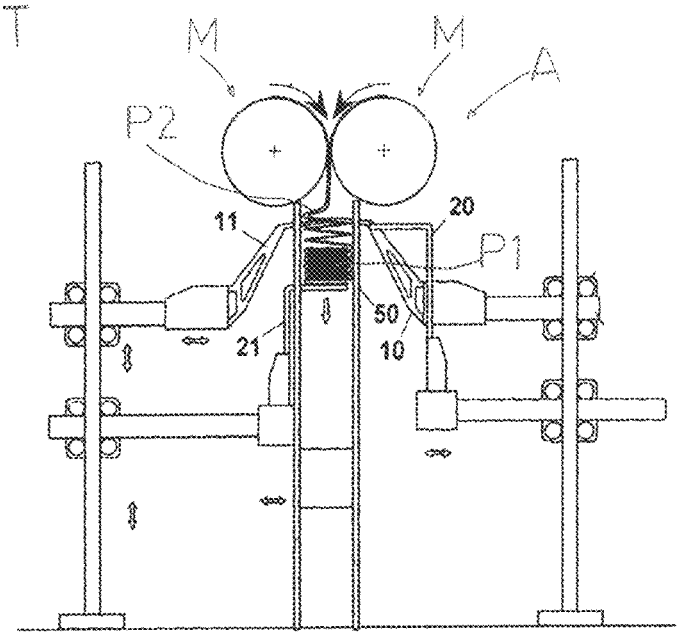
Figure 2C:
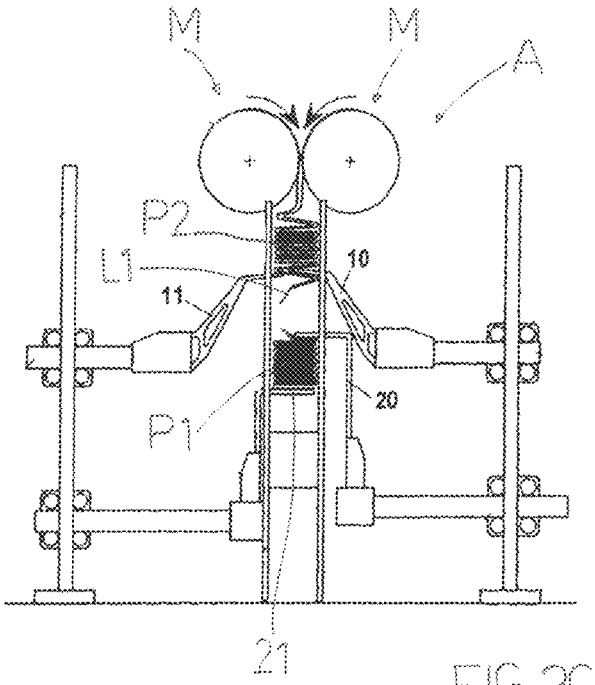
FIG. 2C PRIOR ART
Figure 2D:
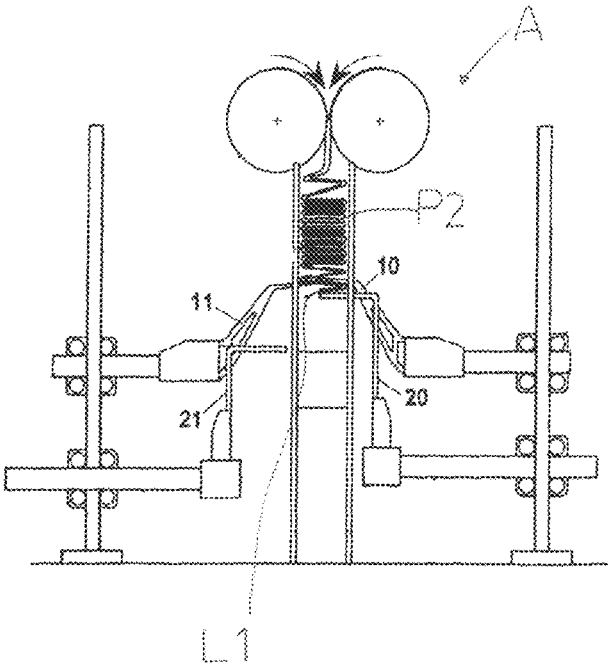
Figure 3A:
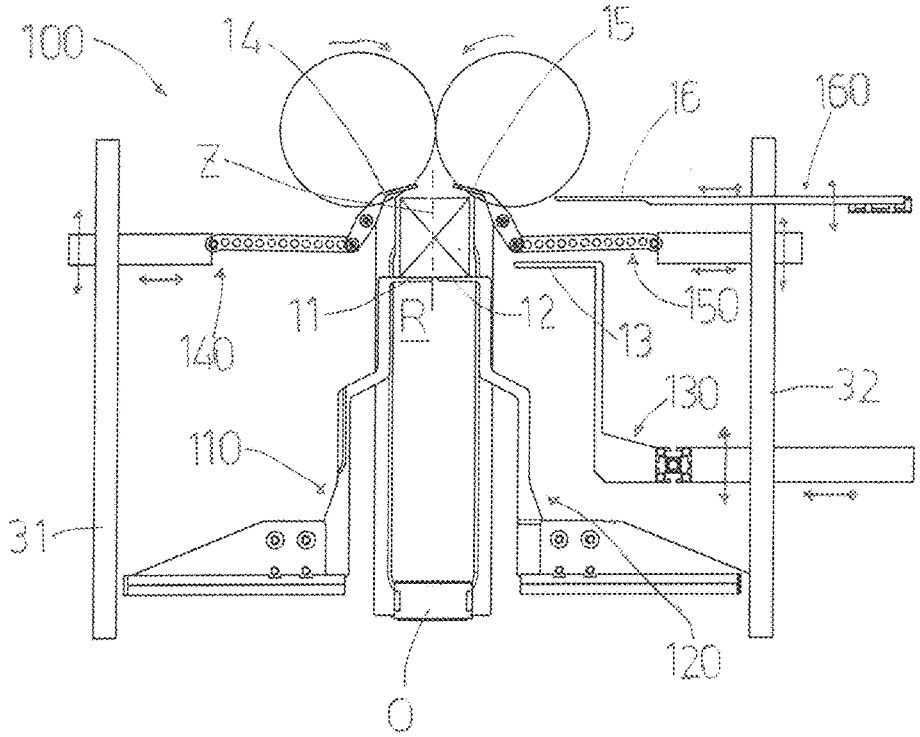

The method comprises carrying out steps of:

positioning the pair of support tables (11, 12) in a raised position facing one another, and in a configuration (R) neared one another, transversally to a vertical direction (Z) along which the folding of interfolded sheets joined by a pre-tear or perforation line takes place in order to form stacks of interfolded sheets, for supporting the folded and interfolded sheets during the formation of a stack (PA) (see for example FIG. 3A);

translating the pair of support tables (11, 12) vertically downwards to enable complete formation of a stack (PA) of interfolded sheets of a predetermined height;

positioning the pair of separator elements (14, 15) in a position in which they are splayed and are bilateral to the vertical direction (Z) at the sides of the stack (PA) of interfolded sheets during the formation and completion of the stack (PA) on the pair of support tables (11, 12);

positioning the separating board (13) in a lateral position with respect to the vertical direction (Z) along which the formation and completion of the stack (PA) of the interfolded sheets on the pair of support tables (11, 12) takes place.

Figure 3B:
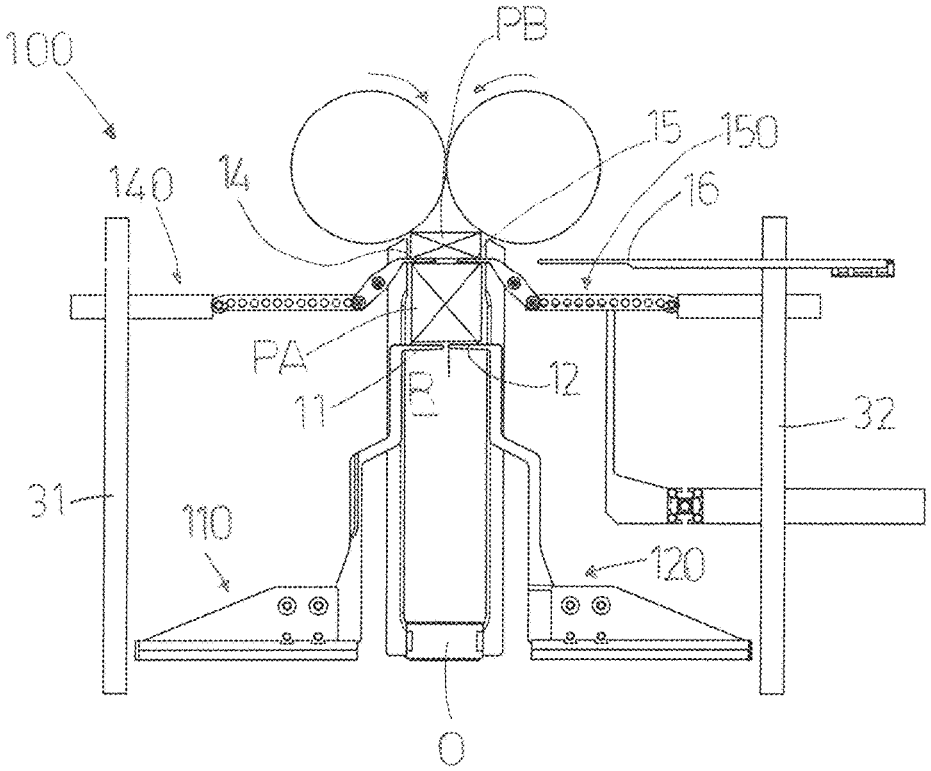
Figure 3C:
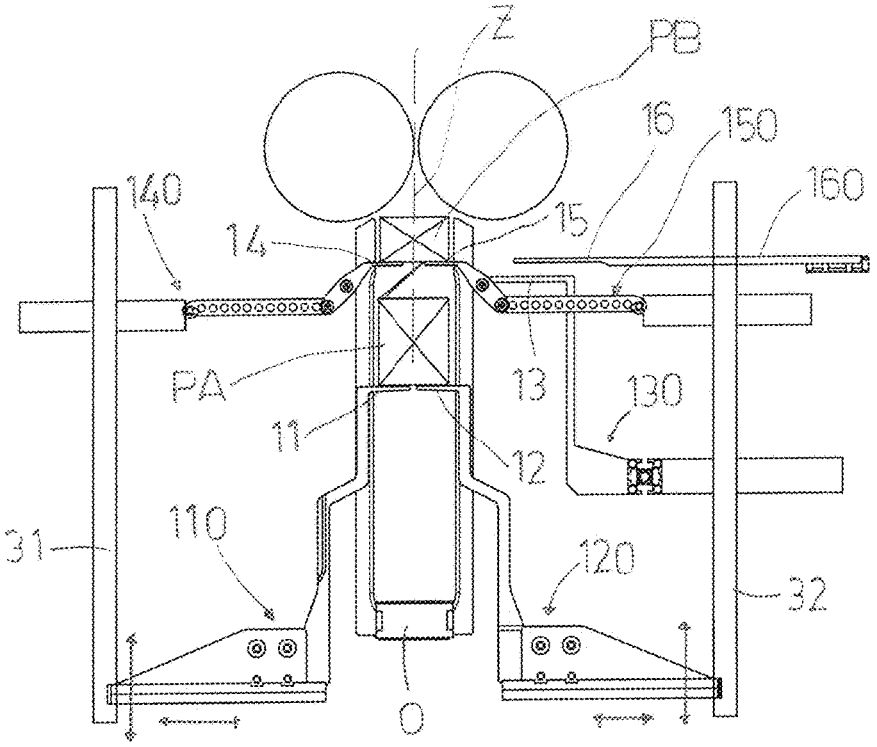
Figure 3D:
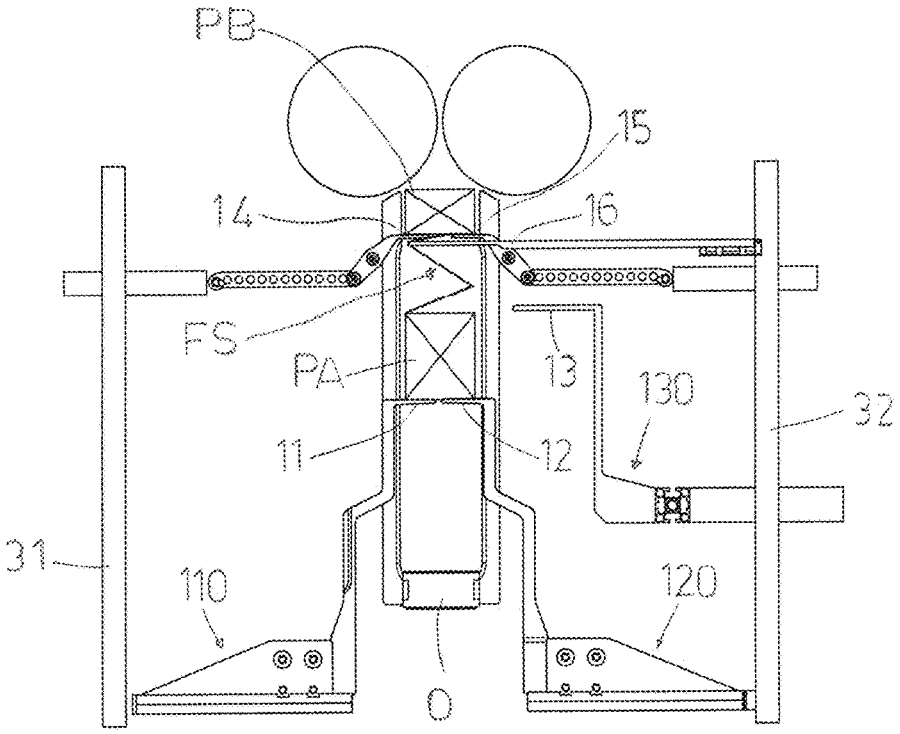
Figure 3E:
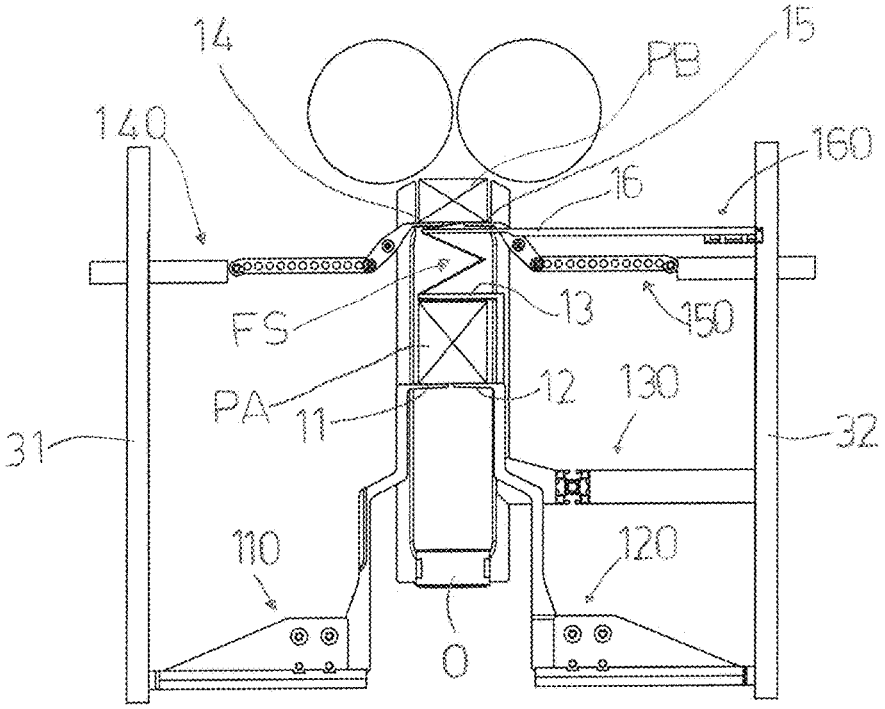
Figure 3F:
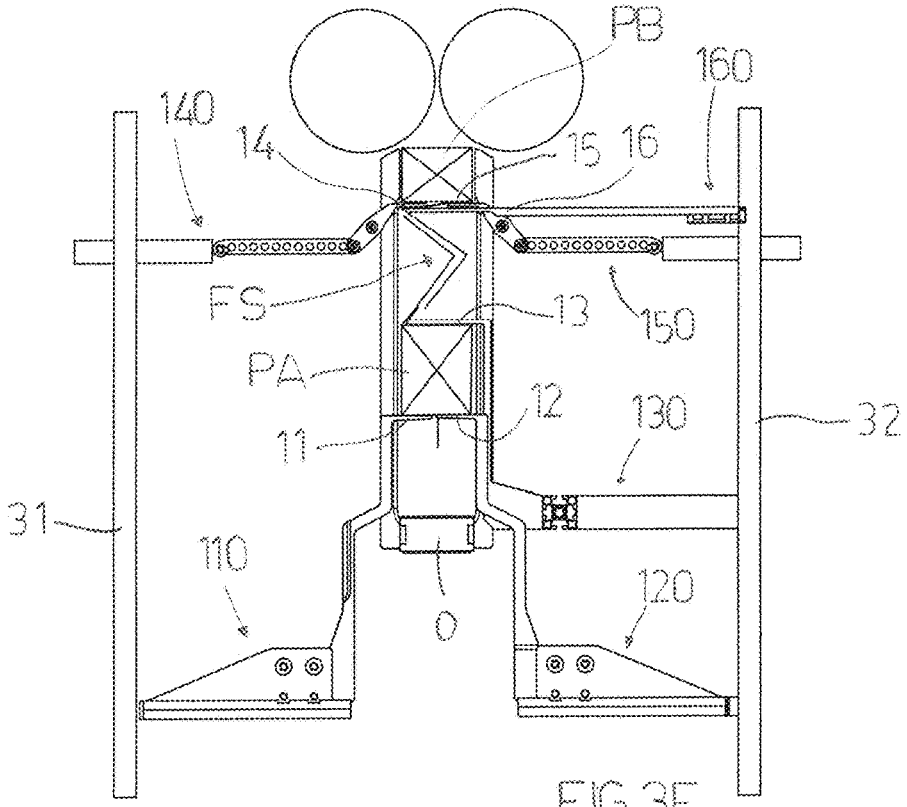
Figure 3G:
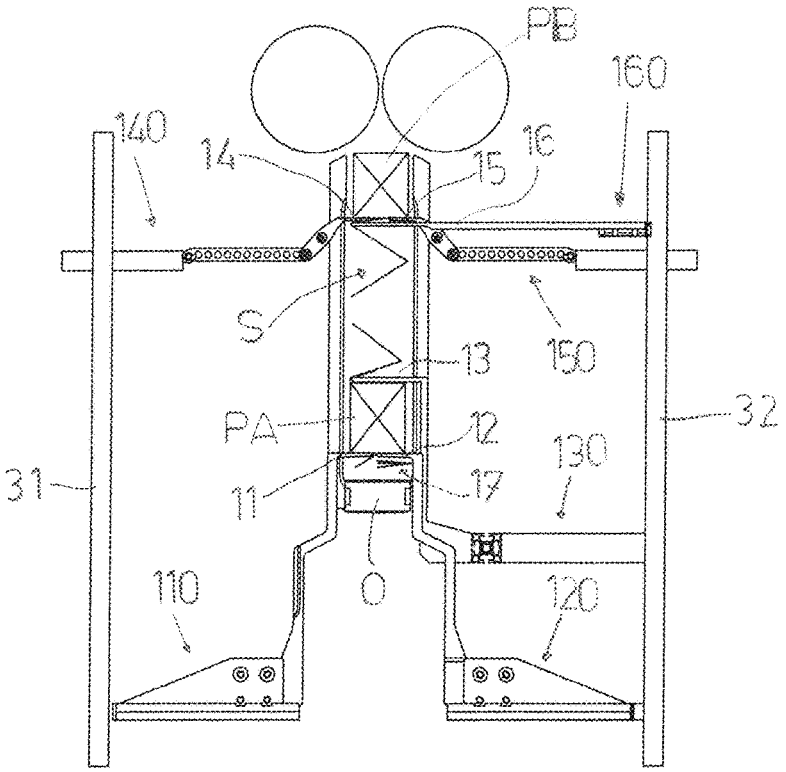
Figure 3H:
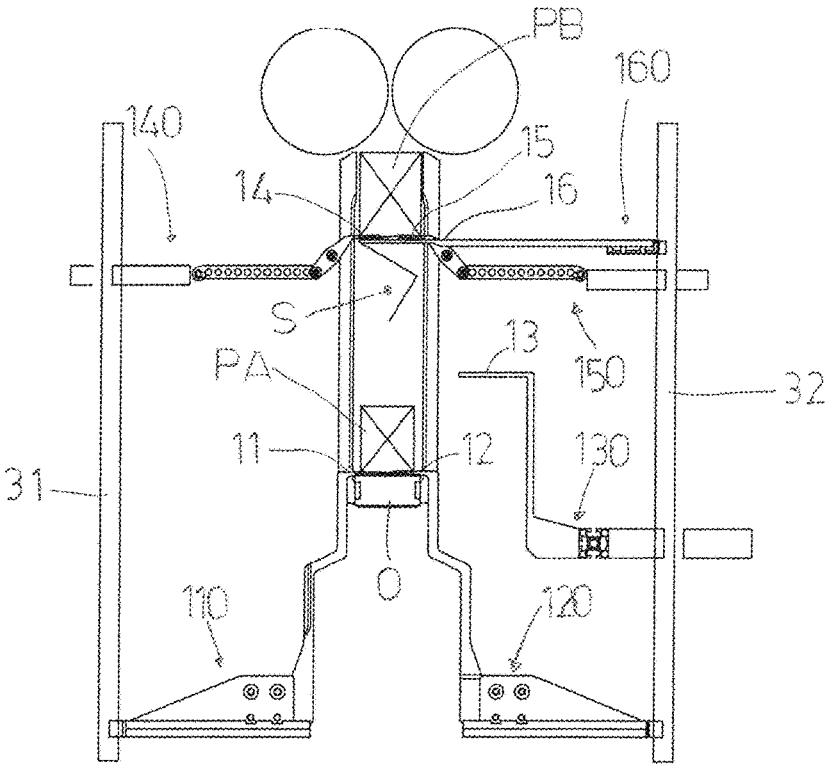
Figure 3I:
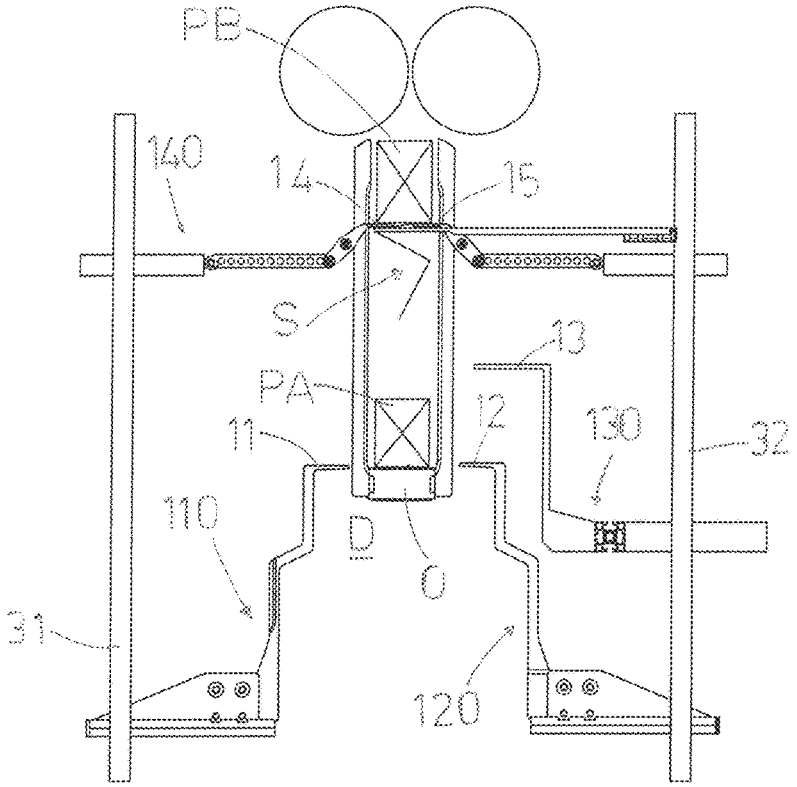

The method also comprises carrying out steps of:

having completed the formation of a stack (PA) of interfolded sheets of a predetermined height: moving the pair of separator elements (14, 15) transversally to the vertical direction (Z) so as to bring them into a position in which they are mutually neared in such a way as to insert the separator elements (14, 15) between consecutive connecting sheets between the folded sheet of the already-formed stack (PA) and a first folded sheet of a successive stack (PB) under formation in order to support the successive stack (PB) under formation (see FIG. 3B), then lowering the pair of support tables (11, 12) so as to move the already-formed stack (PA) away from the successive stack (PB) under formation supported by the pair of separator elements (14, 15), unfolding a series of connecting sheets (FS) between the last sheet of the already-formed stack (PA) and the first sheet of the successive stack (PB) under formation (see FIGS. 3C and 3D);

moving the separating board (13) transversally to the vertical direction (Z) in order to position the separating board (13) above the already-formed stack (PA) supported by the pair of support tables (11; 12) (FIG. 3E);

translating the pair of support tables (11, 12) and the separating board (13) vertically downwards so as to move the already-formed stack (PA) away from the successive stack (PB) under formation in such a way as to separate the connecting sheets (FS) between the two stacks (PA, PB) at a pre-tear or perforation line present thereon leaving a strip(S) of sheets hanging below the stack (PB) under formation on the pair of separator elements (14, 15) (FIGS. 3F and 3G);

moving the separating board (13) away from the formed stack (PA) (FIG. 3H);

moving the pair of support tables (11, 12) away from one another so as to position the support tables (11,12) in a reciprocally moved-away position in order to release the stack (PA) formed above a conveyor (O) (FIG. 31).

Figure 3L:
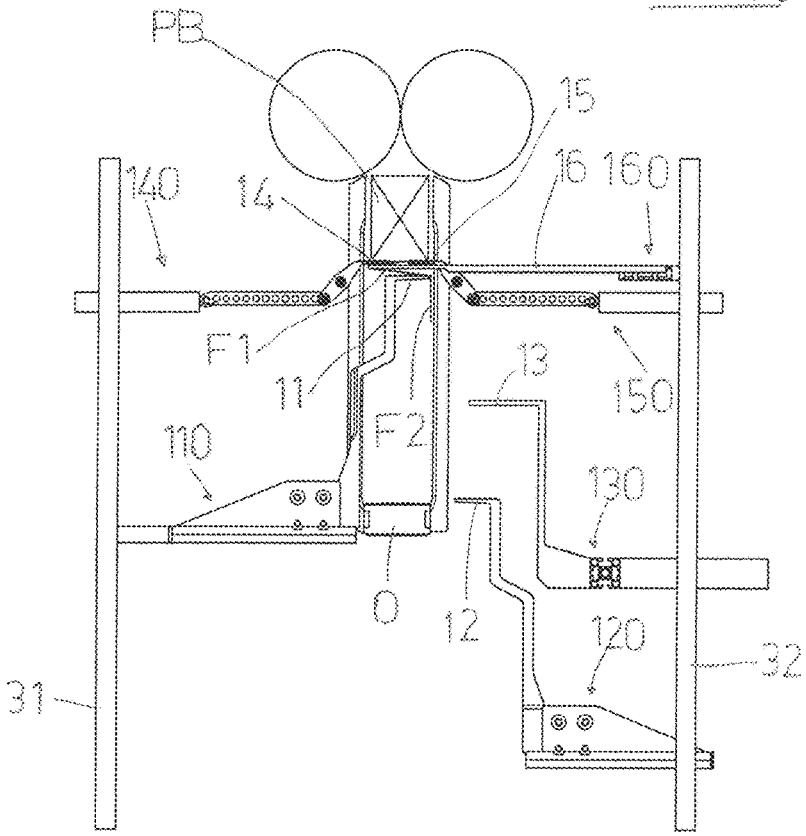
Figure 3M:
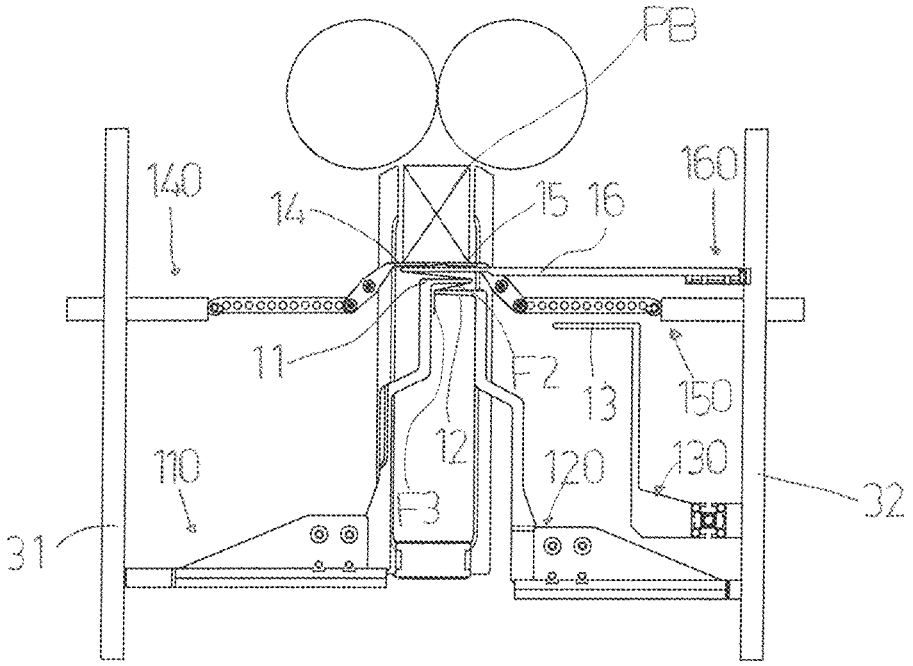
Figure 3N:
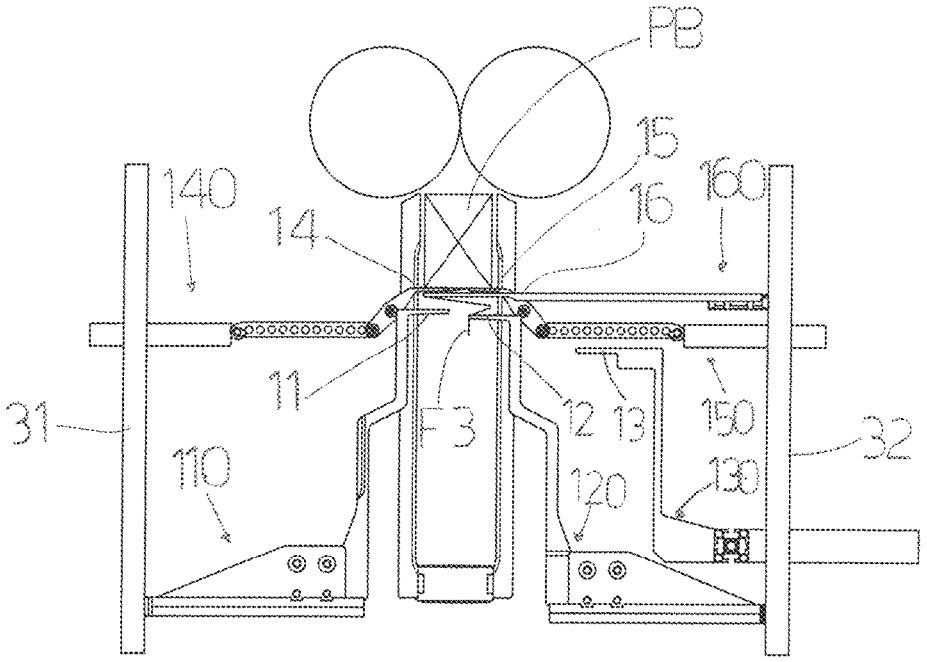
Figure 3O:
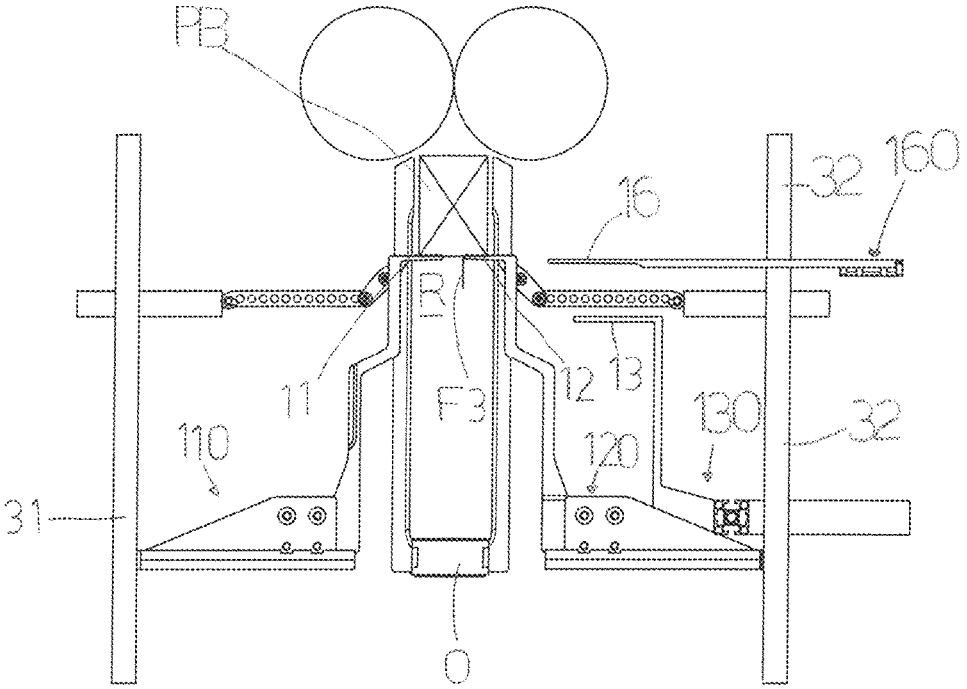
Figure 3P:
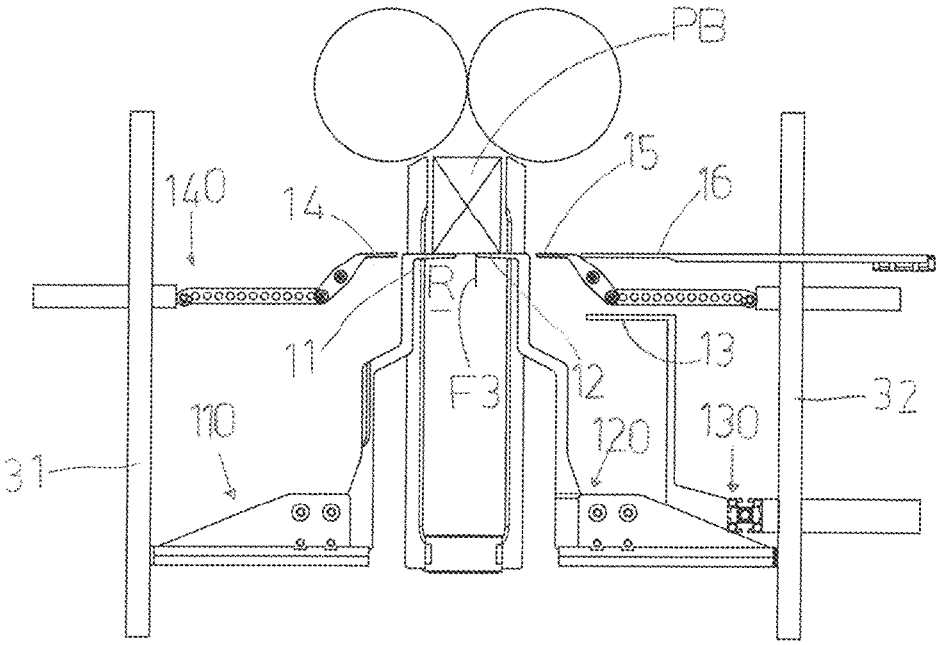

The method of the invention also comprises carrying out the following special steps:

moving a first support table (11) of the pair of support tables (11, 12) upwards into a lower position than the pair of separator elements (14, 15) and moving the first support table (11) transversally to the vertical direction (Z) to abut the strip(S) of hanging sheets and to fold a first portion (F1) of the strip(S) of hanging sheets below the successive stack (PB) under formation on the pair of separator elements (14, 15) leaving a second portion (F2) of the strip(S) of sheets hanging below the first support table (11) (FIG. 3L);

moving a second support table (12) of the pair of support tables (11, 12) upwards into a lower position than the pair of separator elements (14, 15) and moving the second support table (12) transversally to the vertical direction (Z) to abut the second portion (F2) of the strip(S) of hanging sheets to partially fold the second portion (F2) below the first support table (11) leaving an end flap (F3) of the second portion (F2) partially folded and hanging below the second support table (12) (FIG. 3M);

moving the first support table (11) and the second support table (12) in order to arrange them facing one another and in the configuration (R) neared one another;

raising the first support table (11) and the second support table (12) in order to arrange them against the successive stack (PB) under formation on the pair of separator elements (14, 15) leaving the end flap (F3) partially folded and hanging between the first support table (11) and second support table (12) (FIG. 30);

moving the pair of separator elements (14, 15) away from one another in order to disengage the successive stack (PB) under formation and so as to release the successive stack (PB) under formation to rest on the first support table (11) and on the second support table (12) (FIG. 3P);

translating the first support table (11) and the second support table (12) vertically downwards up to complete formation of the successive stack (PB) obtaining a pack (P) of interfolded sheets with the end flap (F3) partially folded and hanging there-between and remaining projecting below the pack (P) to define a grippable flap (L) for a facilitated extraction of the sheets from the pack.

Owing also the presence of the pair of support tables, instead of one alone in the above-described prior art, and owing to the special movement mode of the two support tables, with the method of the invention it is possible to use the separating board only for the separation of two consecutive stacks, as the two support tables are utilised to carry out the folding of the strip of sheets which remain hanging below the stack under formation, once separated from the stack already-formed.

Therefore the two support tables, once the folding has been completed, are already in a position such as to be immediately used for support of the successive stack under formation, enabling the pair of separator elements to be returned into the splayed configuration.

This enables obtaining a production regime that is higher than in the prior art described in the foregoing.

Further, the folding of this strip of hanging sheets is carried out by the two support tables in a special mode that enables leaving defined an end flap (F3) partially folded and projecting inferiorly from the pack (P) to define a grippable flap (L) for a facilitated extraction of the sheets from the pack.

Further special aspects of the method of the invention are described in the following.

The method comprises predisposing a sheet-stretching element (16) laterally to the vertical direction (Z) and maintaining the sheet-stretching element (16) in a lateral position which is external with respect to a stack under formation.

The function of the sheet-stretching element (16) is the following.

Before the step of moving a first support table (11) of the pair of support tables (11, 12) upwards into a lower position than the pair of separator elements (14, 15) and moving the first support table (11) transversally to the vertical direction (Z) to abut the strip(S) of hanging sheets and to fold a first portion (F1) of the strip(S) of hanging sheets below the successive stack (PB) under formation on the pair of separator elements (14, 15) leaving a second portion (F2) of the strip(S) of sheets hanging below the first support table (11), the method comprises carrying out a step of moving the sheet-stretching element (16) transversally to the vertical direction (Z), and below the pair of separator elements (14, 15), so as to abut the hanging strip(S) below the stack (PB) under formation on the pair of separator elements (14, 15).

This advantageously enables extending an initial part of the strip(S) below the stack (PB) under formation leaving the first portion (F1) and the second portion (F2) of the strip(S) hanging below the stack under formation(S).

This moving performed by the sheet-stretching element will facilitate the operations of folding the strip of hanging sheets by the two support tables for the formation of the end flap to be made to remain projecting beneath the pack of sheets.

In other aspects, the method of the invention can include moving the sheet-stretching element (16) transversally to the vertical direction (Z), and below the pair of separator elements (14, 15) in the neared position thereof, in such a way as to abut the strip(S) of sheets hanging below the stack (PB) under formation on the pair of separator elements (14, 15) and stretching an initial part of the strip(S) below the stack (PB) under formation leaving the first portion (F1) and the second portion (F2) of the strip(S) hanging below the stack under formation(S), at any time after the step of moving the pair of separator elements (14, 15) transversally to the vertical direction (Z) so as to bring them into a position in which they are mutually neared in order to support the successive stack (PB) under formation, but in any case before the step of moving a first support table (11) of the pair of support tables (11, 12) upwards.

In a further advantageous aspect, the method of the invention can comprise, before the step of translating the pair of support tables (11, 12) and the separating board (13)

vertically downwards in order to move the already-formed stack (PA) away from the successive stack (PB) under formation, carrying out a step of raising the pair of support tables (11, 12) towards the separating board (13), maintaining the separating board (13) stationary, so as to compact the stack (PA) already formed.

A further and other aspect of the method of the invention consists in the fact that the method comprises directing a puff of air against the end flap (F3) partially folded and hanging between the pair of support tables (11, 12) and which remains projecting inferiorly from the pack (P) so as to fold the end flap against the lower part of the pack (P) before the pack (P) is released by the pair of support tables (11, 12) on the conveyor (O).

In figures from 3A to 3P, reference numeral (100) denotes a preferred embodiment of the apparatus for carrying out the method of the invention.

The apparatus (100) comprises a pair of support tables (11, 12), for example the two support tables are constituted by elements having an overturned L shape.

A first support table (11) is borne by a first frame (110) which is mounted vertically slidingly along a first vertical sliding guide (31), with the first frame (110) also being predisposed to be movable transversally to the first vertical sliding guide (31) in such a way that the first support table (11) can be movable both vertically and parallel to the vertical direction (Z), along which the formation of the stacks of interfolded sheets takes place, and transversally to the vertical direction (Z).

For example, the first frame (110) can be mounted and borne slidably, from a first carriage (not illustrated as of known type) which, in turn, is mounted slidably on the first vertical sliding guide (31).

A second support table (12) is borne by a second frame (120) which is mounted vertically slidingly along the second vertical sliding guide (32), parallel to the first vertical sliding guide (31) and arranged on an opposite side to the first vertical sliding guide (31) with respect to the vertical direction (Z) of formation of the stack of interfolded sheets, with the second frame (120) also being predisposed to be transversally movable with respect to the second vertical sliding guide (32) in such a way that the second support table (12) can be movable both vertically and parallel to the vertical direction (Z), along which the formation of the stacks of interfolded sheets takes place, and transversally to the vertical direction (Z).

For example, the second frame (120) can be mounted and borne slidably by a second carriage (not illustrated as of known type) which, in turn, is mounted slidably on the second vertical sliding guide (32).

The apparatus (100) further comprises a separating board (13) which is borne by a third frame (130), wherein the third frame (130) is mounted vertically slidingly along the first vertical sliding guide (31) or the second vertical sliding guide (32), with the third frame (130) also being predisposed to be transversally movable with respect to the first vertical sliding guide (31) or to the second vertical sliding guide (32) in such a way that the separating board (13) can be movable both vertically and parallel to the vertical direction (Z), along which the formation of the stacks of interfolded sheets takes place, and transversally to the vertical direction (Z).

For example, the third frame (130) can be mounted and borne slidably by a third carriage (not illustrated as of known type) which, in turn, is mounted slidably on the first vertical sliding guide (31) or on the second vertical sliding guide (32).

The apparatus (100) also has a pair of separator elements (14, 15).

A first separator element (14) is borne by a fourth frame (140) which is mounted vertically slidingly along a first vertical sliding guide (31), with the fourth frame (140) also being predisposed to be transversally movable with respect to the first vertical sliding guide (31) in such a way that the first separator element (14) can be movable both vertically and parallel to the vertical direction (Z), along which the formation of the stacks of interfolded sheets takes place, and transversally to the vertical direction (Z).

For example, the fourth frame (140) can be mounted and borne slidably by a fourth carriage (not illustrated as of known type) which, in turn, is mounted slidably on the first vertical sliding guide (31).

A second separator element (15) is borne by a fifth frame (150) which is mounted vertically slidingly along a second vertical sliding guide (32), parallel to the first vertical sliding guide (31) and arranged on an opposite side to the first vertical sliding guide (31) with respect to the vertical direction (Z) of formation of the stack of interfolded sheets, with the fifth frame (150) also being predisposed to be transversally movable with respect to the second vertical sliding guide (32) in such a way that the second separator element (15) can be movable both vertically and parallel to the vertical direction (Z), along which the formation of the stacks of interfolded sheets takes place, and transversally to the vertical direction (Z).

For example, the fifth frame (150) can be mounted and borne slidably by a fifth carriage (not illustrated as of known type) which, in turn, is mounted slidably on the second vertical sliding guide (32).

In a preferred aspect, the apparatus (100) comprises a sheet-stretching element (16) borne by a sixth frame (16).

The sixth frame (16) is mounted vertically slidingly along the first vertical sliding guide (31) or the second vertical sliding guide (32), with the sixth frame (160) which is also predisposed to be transversally movable with respect to the first vertical sliding guide (31) or to the second vertical sliding guide (32) in such a way that the sheet-stretching element (16) can be movable both vertically and parallel to the vertical direction (Z), along which the formation of the stacks of interfolded sheets takes place, and transversally to the vertical direction (Z).

For example, the sixth frame (160) can be mounted and borne slidably by a sixth carriage (not illustrated as of known type) which, in turn, is mounted slidably on the second vertical sliding guide (32).

The apparatus (100) can also comprise blowing means (17) of an air flow. The blowing means (17) of an air flow can for example be constituted by nozzles, advantageously predisposed and mounted on an arm of the L of one of the two support tables (11, 12) and can be connected to a source of compressed air.

Owing to the above-described structure, the apparatus (100) is thus configured so as to be able to carry out the steps of the method of the invention for obtaining a pack (P) of interfolded sheets, wherein the interfolded sheets of the pack are joined to one another by a pre-tear or perforation line, with an end sheet (S1) of the pack being partially folded on itself so as to form a grippable flap (L) for a facilitated extraction of the sheets from the pack such as the pack (P) illustrated schematically in FIG. 1E.

The invention claimed is:

1. A method for separating two successive stacks of interfolded sheets of a type joined by a pre-tear or perforation line and for obtaining a pack of interfolded sheets wherein an end sheet of the pack is partially folded on itself to define a grippable flap for a facilitated extraction of the sheets from the pack, comprising:

predisposing a pair of support tables movable independently of one another;

predisposing a separating board, movable independently of the pair of support tables;

predisposing a pair of separator elements arranged facing one another and movable independently of one another and independently of the pair of support tables and of the separating table;

and comprising carrying out steps of:

positioning the pair of support tables in a raised position facing one another, and in a configuration neared one another, transversally to a vertical direction along which the folding of interfolded sheets joined by a pre-tear or perforation line takes place in order to form stacks of interfolded sheets, for supporting the folded and interfolded sheets during the formation of a stack;

translating the pair of support tables vertically downwards to enable complete formation of a stack of interfolded sheets of a predetermined height;

positioning the pair of separator elements in a position in which they are splayed and are bilateral to the vertical direction at the sides of the stack of interfolded sheets during the formation and completion of the stack on the pair of support tables;

positioning the separating board in a lateral position with respect to the vertical direction along which the formation and completion of the stack of the interfolded sheets on the pair of support tables takes place;

having completed the formation of a stack of interfolded sheets of a predetermined height: moving the pair of separator elements transversally to the vertical direction so as to bring them into a position in which they are mutually neared in such a way as to insert the separator elements between consecutive connecting sheets between the folded sheet of the already-formed stack and a first folded sheet of a successive stack under formation in order to support the successive stack under formation, then lowering the pair of support tables so as to move the already-formed stack away from the successive stack under formation supported by the pair of separator elements, unfolding a series of connecting sheets between the last sheet of the already-formed stack and the first sheet of the successive stack under formation;

moving the separating board transversally to the vertical direction in order to position the separating board above the already-formed stack supported by the pair of support tables;

translating the pair of support tables and the separating board vertically downwards so as to move the already-formed stack away from the successive stack under formation in such a way as to separate the connecting sheets between the two stacks at a pre-tear or perforation line present thereon leaving a strip of sheets hanging below the stack under formation on the pair of separator elements;

moving the separating board away from the formed stack;

moving the pair of support tables away from one another so as to position the support tables in a reciprocally moved-away position in order to release the stack formed above a conveyor;

moving a first support table of the pair of support tables upwards into a lower position than the pair of separator elements and moving the first support table transversally to the vertical direction to abut the strip of hanging sheets and to fold a first portion of the strip of hanging sheets below the successive stack under formation on the pair of separator elements leaving a second portion of the strip of sheets hanging below the first support table;

moving a second support table of the pair of support tables upwards into a lower position than the pair of separator elements and moving the second support table transversally to the vertical direction to abut the second portion of the strip of hanging sheets to partially fold the second portion below the first support table leaving an end flap of the second portion partially folded and hanging below the second support table;

moving the first support table and the second support table in order to arrange them facing one another and in the configuration neared one another;

raising the first support table and the second support table in order to arrange them against the successive stack under formation on the pair of separator elements leaving the end flap partially folded and hanging between the first support table and second support table;

moving the pair of separator elements away from one another in order to disengage the successive stack under formation and so as to release the successive stack under formation to rest on the first support table and on the second support table;

translating the first support table and the second support table vertically downwards up to complete formation of the successive stack obtaining a pack of interfolded sheets with the end flap partially folded and hanging there-between and remaining projecting below the pack to define a grippable flap for a facilitated extraction of the sheets from the pack.

2. The method as claimed in claim 1, comprising predisposing a sheet stretching element laterally to the vertical direction and maintaining the sheet-stretching element in a lateral position which is external with respect to a stack under formation and, before the step of moving a first support table of the pair of support tables upwards into a lower position than the pair of separator elements and moving the first support table transversally to the vertical direction to abut the strip of hanging sheets and folding a first portion of the strip below the successive stack under formation on the pair of separator elements leaving a second portion of the strip hanging below the first support table, the method comprises carrying out a step of moving the sheet-stretching element transversally to the vertical direction, and below the pair of separator elements in the neared position thereof to support the successive stack under formation, in such a way as to abut the strip of sheets hanging below the stack under formation on the pair of separator elements and stretching an initial part of the strip below the stack under formation leaving the first portion and the second portion of the strip hanging below the stack under formation.

3. The method as claimed in claim 2, comprising moving the sheet-stretching element transversally to the vertical direction, and below the pair of separator elements in the neared position thereof, in such a way as to abut the strip of sheets hanging below the stack under formation on the pair of separator elements and stretching an initial part of the strip below the stack under formation leaving the first portion and the second portion of the strip hanging below the stack under formation, at any time after the step of moving the pair of separator elements transversally to the vertical direction so as to bring them into a position in which they are mutually neared and before the step of moving a first support table of the pair of support tables upwards into a lower position than the pair of separator elements and moving the first support table transversally to the vertical direction to abut the strip of hanging sheets and to fold the first portion of the strip below the successive stack under formation of the pair of separator elements leaving a second portion of the strip hanging below the first support table.

4. The method as claimed in claim 3, comprising, before the step of translating the pair of support tables and the separating board vertically downwards in order to move the already-formed stack away from the successive stack under formation, carrying out a step of raising the pair of support tables towards the separating board, maintaining the separating board stationary, so as to compact the stack already formed.

5. The method as claimed in claim 3, comprising, before the step of mutually moving the pair of support tables away from one another in order to position the support tables in a reciprocally moved-away position so as to release the stack formed above a conveyor, carrying out a step of directing a puff of air against the end flap partially folded and hanging between the pair of support tables and which remains projecting inferiorly from the pack so as to fold the end flap against the lower part of the pack.

6. The method as claimed in claim 2, comprising, before the step of translating the pair of support tables and the separating board vertically downwards in order to move the already-formed stack away from the successive stack under formation, carrying out a step of raising the pair of support tables towards the separating board, maintaining the separating board stationary, so as to compact the stack already formed.

7. The method as claimed in claim 2, comprising, before the step of mutually moving the pair of support tables away from one another in order to position the support tables in a reciprocally moved-away position so as to release the stack formed above a conveyor, carrying out a step of directing a puff of air against the end flap partially folded and hanging between the pair of support tables and which remains projecting inferiorly from the pack so as to fold the end flap against the lower part of the pack.

8. The method as claimed in claim 1, comprising, before the step of translating the pair of support tables and the separating board vertically downwards in order to move the already-formed stack away from the successive stack under formation, carrying out a step of raising the pair of support tables towards the separating board, maintaining the separating board stationary, so as to compact the stack already formed.

9. The method as claimed in claim 8, comprising, before the step of mutually moving the pair of support tables away from one another in order to position the support tables in a reciprocally moved-away position so as to release the stack formed above a conveyor, carrying out a step of directing a puff of air against the end flap partially folded and hanging between the pair of support tables and which remains projecting inferiorly from the pack so as to fold the end flap against the lower part of the pack.

10. The method as claimed in claim 1, comprising, before the step of mutually moving the pair of support tables away from one another in order to position the support tables in a reciprocally moved-away position so as to release the stack formed above a conveyor, carrying out a step of directing a puff of air against the end flap partially folded and hanging between the pair of support tables and which remains projecting inferiorly from the pack so as to fold the end flap against the lower part of the pack.

* * * * *